US005765932A

United States Patent [19]

Domina et al.

[11] Patent Number: 5,765,932

[45] Date of Patent: Jun. 16, 1998

[54] UTILITY GROMMET

[75] Inventors: Chris L. Domina, San Francisco; Paul B. Siebert, Burlingame; Eric E. Pante, San Mateo, all of Calif.

[73] Assignee: Steelcase Inc., Grand Rapids, Mich.

[21] Appl. No.: 692,073

[22] Filed: Aug. 7, 1996

[51] Int. Cl.[6] ..... H02G 3/22

[52] U.S. Cl. ..... 312/223.6; 108/50.02

[58] Field of Search ..... 312/194, 196, 312/223.1, 223.3, 223.6, 223.4, 223.5; 16/2; 108/50.02, 23, 26, 26.2

[56] References Cited

U.S. PATENT DOCUMENTS

| | | | |
|---|---|---|---|
| 945,060 | 1/1910 | Tannewitz | 108/26.2 |
| 1,598,304 | 8/1926 | Pearlman | 108/23 |
| 2,820,088 | 1/1958 | Sperry | 16/2 X |
| 3,170,029 | 2/1965 | Stewart . | |
| 3,783,175 | 1/1974 | Timmons . | |
| 4,044,908 | 8/1977 | Dauberger . | |
| 4,334,630 | 6/1982 | Bergin . | |
| 4,718,741 | 1/1988 | Nichoalds . | |
| 5,050,267 | 9/1991 | Quest . | |
| 5,130,494 | 7/1992 | Simonton et al. | 312/223.1 X |
| 5,162,612 | 11/1992 | Naka et al. . | |
| 5,167,047 | 12/1992 | Plumley | 16/2 |
| 5,220,871 | 6/1993 | Grund et al. . | |
| 5,231,562 | 7/1993 | Pierce et al. | 312/194 X |
| 5,237,935 | 8/1993 | Newhouse et al. | 312/223.6 X |
| 5,429,431 | 7/1995 | Olson et al. . | |

FOREIGN PATENT DOCUMENTS

| | | | |
|---|---|---|---|
| 2153911 | 5/1973 | Germany | 108/23 |

*Primary Examiner*—Peter M. Cuomo
*Assistant Examiner*—Janet M. Wilkens
*Attorney, Agent, or Firm*—Price, Heneveld, Cooper, DeWitt & Litton

[57] ABSTRACT

A utility grommet adapted to be mounted in an opening defined by a worksurface of an article of furniture includes a grommet body configured to be supported in an opening on a worksurface of an article of furniture, and first and second spaced apart supports connected to the grommet body for supporting a utility attachment. The utility grommet has the advantage that it can be used either to pass a power cable or communications cable through the worksurface to an amenity supported on the worksurface, or alternatively the grommet can act as a support for any of a variety of different utility attachments.

26 Claims, 3 Drawing Sheets

UTILITY GROMMET

FIELD OF THE INVENTION

This invention relates to utility grommets for worksurfaces of articles of furniture, and more particularly to a combination grommet and support for reversibly mounting a utility attachment to the worksurface of an article of furniture.

BACKGROUND OF THE INVENTION

There is a recognized need for providing means for passing an electrical power cord through a worksurface of an article of furniture, particularly office furniture, such as desks, tables and the like, so that various electrically powered utility attachments, such as task lamps, fans, etc., or other electrically powered devices, such as calculators, computers, etc., can be supported on the worksurface without the power cord being draped over the desk from the utility attachment or device to an electrical outlet on the floor or on a wall. Specifically, it is often, if not generally, desirable to maximize concealment of power cables which are used to supply electricity to various devices which can be advantageously employed on a worksurface in order to improve safety by eliminating or reducing tripping and other hazards associated with loose cords, and to improve the aesthetics of the work area by eliminating or reducing the amount of power cord which is exposed on a worksurface or adjacent to the worksurface. Further, it is desirable to minimize the length of exposed power cords on a worksurface to maximize the area available for work.

For convenience, it is also often desirable to mount a plurality of electrical receptacles on a worksurface, with the cord supplying the electrical power to the receptacles passing through the worksurface. However, electrical receptacles which are permanently mounted on the worksurface may be undesirable, as they tend to present an unsightly distraction and unnecessarily clutter the worksurface if they are not being used. Accordingly, it would be desirable to provide means for quickly and easily mounting and dismounting a plurality of electrical receptacles on a worksurface, as desired.

It is generally known to use grommets with removable cover plates to facilitate passage of electrical cables through a worksurface of an article of furniture. However, the prior art does not disclose a utility grommet with a removable, replaceable cover, and which includes an integral support bracket for releasably mounting electrical receptacles or an electrically powered utility attachment on a worksurface.

U.S. Pat. No. 4,718,741 to Nichoalds discloses a table wall provided with a selectively closable opening for passing flexible electric cords therethrough. The opening may include a grommet with a closure element provided with spring fingers adapted to releasably engage the grommet to hold the closure element in the opening when desired. U.S. Pat. No. 5,050,267 to Quest and U.S. Pat. No. 5,429,431 to Olson et al. each disclose the use of grommets for providing electrical cable access, wherein the grommets are provided with covers having apertures therethrough. However, none of these patents disclose a grommet having a grommet body with integrally attached first and second spaced apart amenity supports connected to the grommet body.

SUMMARY OF THE INVENTION

This invention provides a utility grommet for a worksurface, which, in addition to providing an access-way for passing electrical power cords or the like through the worksurface of an article of furniture, includes integral supports for stably supporting an amenity, such as an electrical receptacle or an electrically powered utility attachment. The invention has the advantage that it can be used with a removable, receptacle cover plate as a conventional grommet to pass a power cable through the worksurface and through a small cable access notch in the cover plate and to an electrically powered device supported on the worksurface adjacent to the grommet, or, alternatively, the grommet can be used as a support onto which an amenity can be reversibly mounted as desired.

The utility grommet of this invention includes a grommet body which is configured to be supported in an opening through a worksurface of an article of furniture, and first and second spaced apart amenity supports connected to the grommet body. The spacing between the amenity supports defines an opening through which a power cable can be passed.

DESCRIPTION OF THE PREFERRED EMBODIMENT

Figure 1:
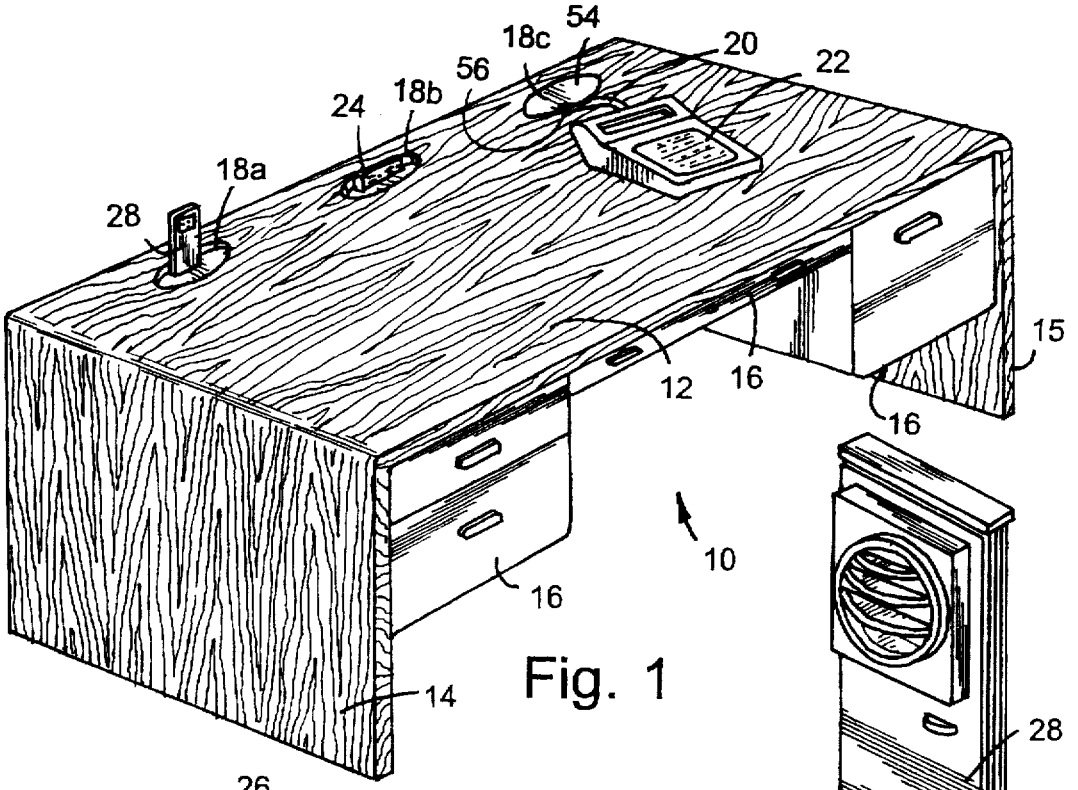
FIG. 1 is a perspective view of a desk employing a plurality of the utility grommets of this invention.

Shown in FIG. 1 is a desk 10 having a worksurface 12 supported on a pair of leg panels 14, 15, and having a plurality of drawers 16. Desk 10 includes a plurality of utility grommets 18*a*, 18*b*, and 18*c*. FIG. 1 illustrates different typical uses for the utility grommets of the invention, grommets 18*a*, 18*b*, and 18*c* themselves being generally identical. In FIG. 1, utility grommet 18*c* is shown being used to pass an electrical power cord 20 through worksurface 12 to supply power to an electrically powered device, such as a desk top calculator 22, supported on the worksurface 12. Grommets 18 can be used in like manner to supply electrical power to generally any type of electrically powered device, such as desk lamps, computer equipment, and electrical pencil sharpener, etc. Further, utility grommets 18 can be used in a similar manner to pass communication cables, such as voice and/or data cables, through worksurface 12 to telephones, computers, facsimile machines, etc. Utility grommet 18*b* is shown in FIG. 1 supporting an electrical power receptacle unit 24 having a plurality of electrical outlets or sockets 26. Grommets 18 can be utilized in a similar manner to support a communications receptacle unit (not shown) having one or more communications outlets or jacks. In FIG. 1 utility grommet 18*a* is shown supporting an electrically powered personal fan 28. Grommets 18, however, can be used for supporting any of a variety of different amenities, such as task lamps or other electrically powered devices.

Figure 2:
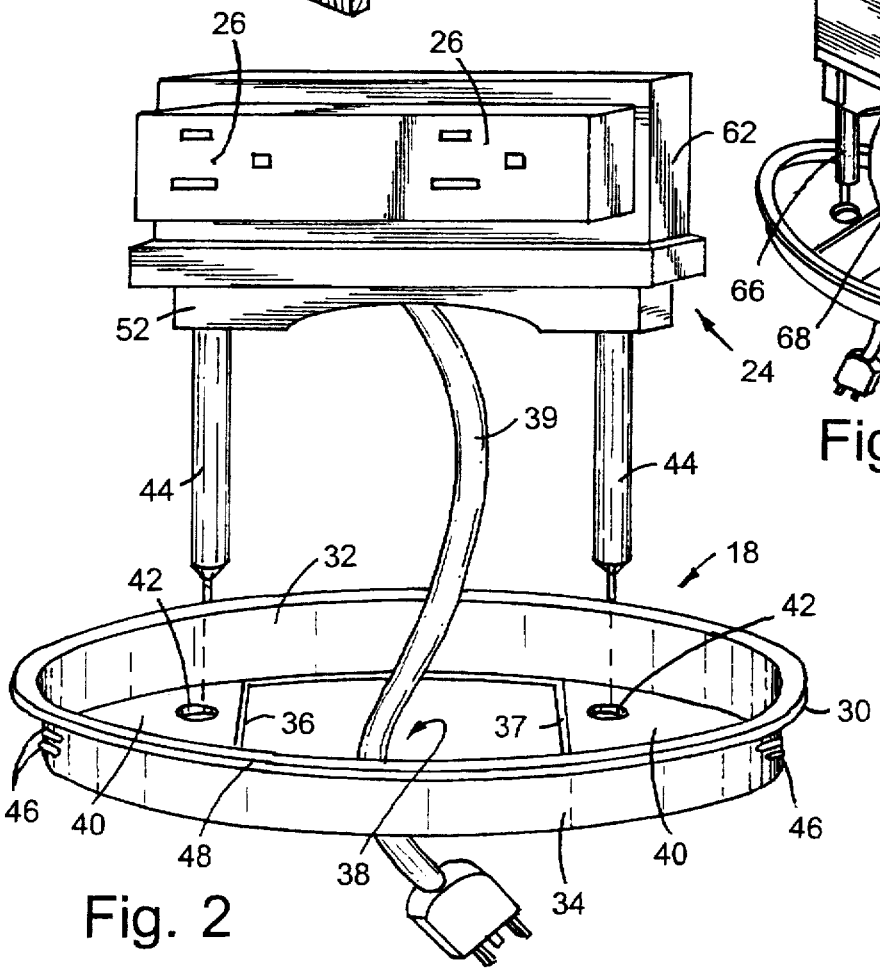
FIG. 2 is an exploded perspective view of the utility grommet and an electrical power receptacle unit which is releasibly mounted on the utility grommet.

The features of utility grommet 18 are shown in greater detail in FIGS. 2–10. With reference to FIG. 2, there is shown a utility grommet 18 and an electrical power receptacle unit 24 which is releasibly mountable on the utility grommet. Grommet 18 includes a grommet body 30 which is configured to be supported in an opening on a worksurface of an article of furniture. More specifically, in the illustrated embodiment, grommet body 30 is generally defined by a peripheral wall 32 having outer surfaces 34 for engaging walls 35 (FIG. 10) defining an opening through worksurface 12, and first and second supports 36 and 37, respectively. Supports 36 and 37 are integral portions of grommet body 30, and are spaced apart from each other to define an opening 38 through which an electrical power cord 39 can be passed. In the illustrated embodiment, supports 36 and 37 include substantially horizontal support surfaces 40 and apertures 42 which are each configured for receiving a corresponding support post 44 on a releasibly mountable amenity such as an electrical power receptacle unit 24.

Figure 10:
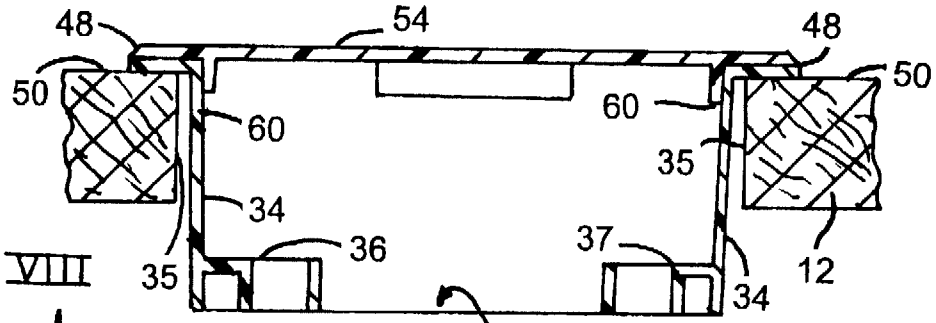
FIG. 10 is an elevational, sectional view of a utility grommet mounted on a worksurface, as viewed along lines X—X of FIG. 1.
Figure 9:
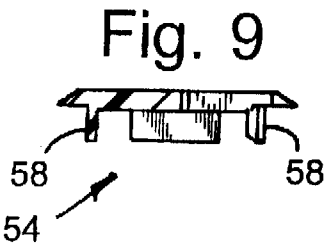
FIG. 9 is an elevational, sectional view of the removable cover for the utility grommet, as view along lines IX—IX of FIG. 7.
Figure 7:
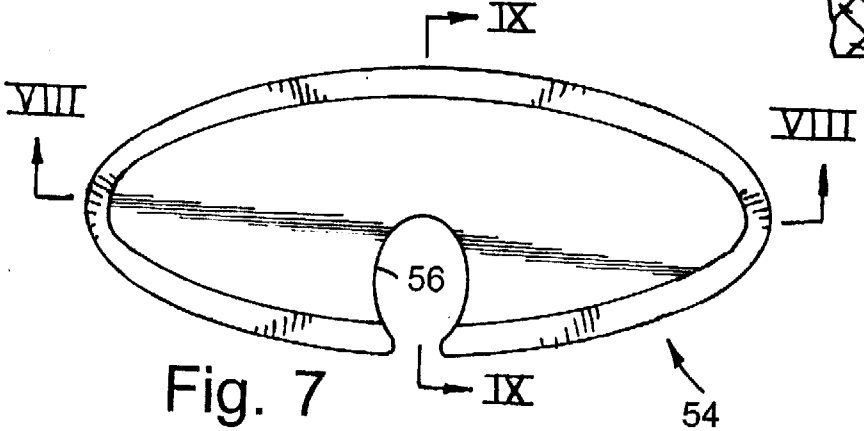
FIG. 7 is a top plan view of a removable cover for the utility grommet.
Figure 8:
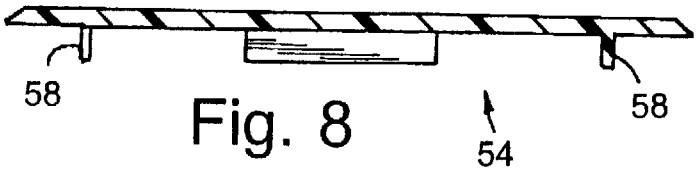
FIG. 8 is an elevational, sectional view of the removable cover for the utility grommet, as view along lines VIII—VIII of FIG. 7.

As shown in FIG. 10, grommet body 30 includes a plurality of features which facilitate secure mounting of grommet 18 in an opening in worksurface 12. To prevent grommet 18 from falling through the opening defined in the worksurface, the opening in the worksurface is preferably defined by walls 35 which taper from the upper side of the worksurface to the lower side of the worksurface. The outer surfaces 34 of peripheral wall 32 are correspondingly tapered to achieve good frictional engagement between the surfaces 34 and walls 35. To further improve frictional engagement between outer surfaces 34 of peripheral wall 32 and walls 35 of worksurface 12, outer surface 34 can be provided with one or more gripping ridges 46. Gripping ridges 46 can also take the form of knurls or other protuberances which can extend horizontally, vertically, diagonally or a combination thereof, and which can intersect. Further, as shown in the illustrated embodiment, a circumferential flange or rim 48 projects horizontally outwardly from an upper end of peripheral wall 32 and engages a substantially upwardly facing surface 50 of worksurface 12. Upwardly facing surface 50 can be a shallow recessed surface adjacent walls 35 which define the opening in worksurface 12. In addition to providing further support for grommet 18, rim 48 provides an easily ascertainable indication of the extent to which grommet 18 should be inserted into the opening defined by walls 35 in worksurface 12.

As shown in the illustrated embodiment, supports 36 and 37 can be recessed downwardly below the level of the upper side of worksurface 12. Recessing supports 36 and 37 below the upper side of worksurface 12 facilitates better engagement between a base portion 52 of a releasibly mountable amenity than would otherwise be possible if the supports were not recessed. Recessed supports as used herein means that the supports are disposed below the upper end of grommet body 30.

With reference to FIGS. 1 and 7–10, there is shown a cap or cover 54 for covering the grommet opening in a worksurface when the utility grommet is not being used, or when it is being used only to pass a power or communication cable or cables through the worksurface and not being used for supporting a releasably mountable amenity, such as an electrical power receptacle unit 24, personal fan 28, etc. Cover 54 is preferably completely removable from the grommet. However, it is contemplated that cover 54 can be hingedly connected to grommet 18. Cover 54 is preferably sized and configured to substantially cover the entire opening in the worksurface, except for one or more notched areas 56 which can be provided for passing a cable through the cap, grommet and worksurface. Cover 54 is provided with a plurality of depending tabs 58 which engage interior surfaces 60 of peripheral wall 32. Tabs 58 serve as locators to properly position cover 54 over grommet 18, and may, if desired, be resiliently biased to frictionally engage interior surfaces 60 of peripheral wall 32.

Referring to FIG. 2, a particularly useful releasably mountable amenity is an electrical power receptacle unit 24 generally comprising an upper housing portion 62 containing one or more electrical receptacles, and a base portion 52 having depending posts 44 which are suitably spaced apart to permit insertion of posts 44 into a corresponding one of the apertures 42 defined by supports 36 and 37. Extending downwardly from the underside of base 52 is an electrical power cord 39 which can be passed through the opening 38 between supports 36 and 37 of grommet 18.

Figure 3:
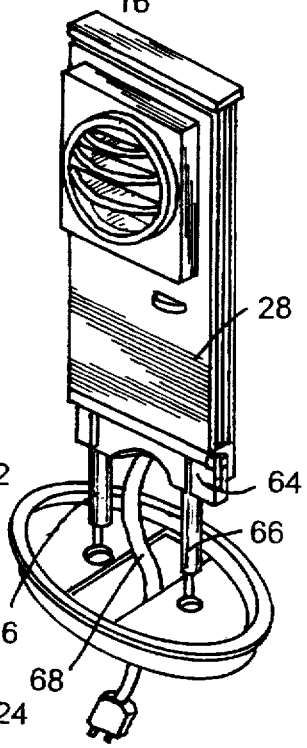
FIG. 3 is an exploded perspective view of the utility grommet and an electrically powered fan which is releasibly mounted on the utility grommet.

In FIG. 3 there is shown another example of a releasably mountable amenity comprising a personal fan 28 having a base 64, which can be substantially identical to base portion 52 of amenity 24. Base 64 includes suitably spaced apart depending posts 66 which are generally similar to posts 44, and a power cord 68 which extends downwardly from the underside of base 64.

Figure 6:
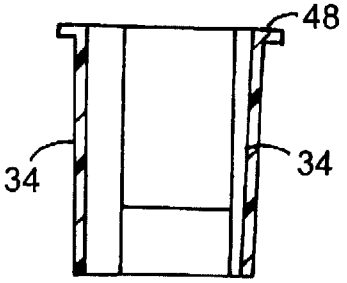
FIG. 6 is an elevational, sectional view of the utility grommet, as viewed along lines VI—VI of FIG. 4.
Figure 4:
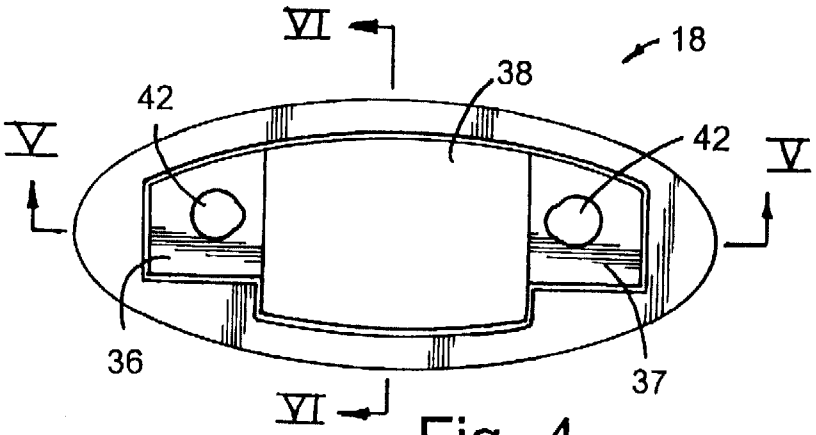
FIG. 4 is a top plan view of slightly modified, alternative embodiment of the utility grommet.
Figure 5:
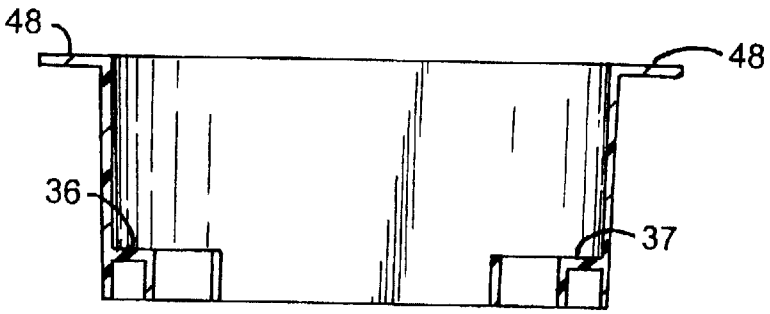
FIG. 5 is an elevational, sectional view of the utility grommet, as viewed along lines V—V of FIG. 4.

FIGS. 4–6 show a slightly modified, alternative embodiment of the grommet 18 wherein the shape or outline of wall 32 non-oval, and wherein apertures 42 are slightly modified to allow alternatively configured posts 44 or 66 to be inserted therein.

It is contemplated that grommet 18 can be used for supporting any of a variety of amenities, including non-powered amenities, electrically powered amenities, and personal communications amenities such as a telephone.

The grommet and cover plate can be made of any suitable material such as an injection moldable thermoplastic (e.g., polypropylene, polyethylene).

It will be apparent to those skilled in the art that various modifications to the preferred embodiment of the invention as described herein can be made without departing from the spirit or scope of the invention as defined by the appended claims.

The embodiments of the invention in which an exclusive property or privilege is claimed are defined as follows:

1. A utility grommet configured to be mounted in an opening defined by a worksurface of an article of furniture, comprising:

a grommet body which is configured to be supported in the opening through the worksurface; and first and second spaced apart amenity supports integrally connected to the grommet body, the spacing between the supports defining an opening through which a power cable can be passed, each of the supports including an aperture for receiving a post of a releasably supportable amenity.

2. The grommet of claim 1, wherein the supports have upwardly facing, horizontal support surfaces.

3. The grommet of claim 1, wherein the grommet body is comprised of a peripheral wall for engaging walls defining the opening in the worksurface.

4. The grommet of claim 3, further comprising a perimeter rim which projects horizontally outwardly from an upper end of the peripheral wall.

5. The grommet of claim 3, wherein the supports are disposed below an upper end of the peripheral wall.

6. The grommet of claim 3, wherein the peripheral wall includes gripping ridges for enhancing engagement between the grommet and walls defining the opening in the worksurface.

7. The grommet of claim 1, further comprising a cover for substantially covering the grommet.

8. The grommet of claim 8, wherein the cover includes a notch, whereby a cable can be passed through the cover and the grommet.

9. The grommet of claim 1, further comprising an amenity attached to a base, and first and second spaced apart posts extending downwardly from the base and configured to be received in the corresponding apertures of the first and second supports.

10. A utility grommet configured to be mounted in an opening defined by a worksurface of an article of furniture, comprising:

a grommet body configured to be supported in the opening on the worksurface of the article of furniture, the grommet body including a peripheral wall, and first and second spaced apart supports integrally connected to the peripheral wall, each of the supports having an aperture configured for receiving a corresponding post of an amenity, the spacing between the supports defining an opening through which a power cable can be passed.

11. The grommet of claim 10, wherein the supports have upwardly facing, horizontal support surfaces.

12. The grommet of claim 11, further comprising a perimeter rim which projects horizontally outwardly from an upper end of the peripheral wall.

13. The grommet of claim 12, wherein the supports are disposed below the upper end of the peripheral wall.

14. The grommet of claim 13, wherein the peripheral wall includes gripping ridges for enhancing engagement between the grommet and walls defining the opening in the worksurface.

15. The grommet of claim 10, further comprising a cover for substantially covering the grommet.

16. The grommet of claim 15, wherein the cover includes a notch, whereby a cable can be passed through the cover and the grommet.

17. The grommet of claim 10, further comprising an amenity attached to a base, and first and second spaced apart posts extending downwardly from the base and configured to be received in the corresponding apertures of the first and second supports.

18. A utility attachment mounted on a utility grommet having spaced apart, apertured supports, comprising:

an amenity attached to a base, and first and second support posts extending downwardly from the underside of the base; the spaced apart, apertured supports defining an opening through which a power cable can be passed.

19. The utility attachment of claim 18, wherein the amenity is a housing containing at least one receptacle, and further comprising a power cable extending downwardly from the underside of the base.

20. An article of furniture, comprising:

a worksurface defining an opening therethrough;

a utility grommet supported in the opening, the grommet including a grommet body comprising a peripheral wall and first and second supports integrally connected to the peripheral wall, each of the supports having an aperture configured for receiving a support post of a utility attachment, the spacing between the supports defining an opening through which a power cable can be passed.

21. The article of furniture of claim 20, wherein the supports have upwardly facing, horizontal support surfaces.

22. The article of furniture of claim 21, further comprising a cover for substantially covering the grommet.

23. The article of furniture of claim 22, wherein the cover includes a notch, whereby a cable can be passed through the cover and the grommet.

24. The article of furniture of claim 20, further comprising an amenity attached to a base, and first and second spaced apart posts extending downwardly from the base and configured to be received in the corresponding apertures of the first and second supports.

25. A utility grommet configured to be mounted in an opening defined by a worksurface of an article of furniture, comprising:

a grommet body which is configured to be supported in the opening through the worksurface; and first and second spaced apart amenity supports, the supports and grommet body defining a one-piece structure, the amenity supports being separated from each other and defining a space therebetween through which a power cable can be passed.

26. The grommet of claim 25, wherein each of the supports includes an aperture for receiving a post of a realeasably supportable amenity.

* * * * *

UNITED STATES PATENT AND TRADEMARK OFFICE

CERTIFICATE OF CORRECTION

PATENT NO. :5,765,932
DATED :June 16, 1998
INVENTOR(S) :Chris L. Domina, et al

It is certified that error appears in the above-identified patent and that said Letters Patent is hereby corrected as shown below:

Column 2, lines 27 and 29;
"releasibly" should be --releasably--.

Column 2, lines 41 and 44;
"view" should be --viewed--.

Column 3, line 15;
"releasibly" should be --releasably--.

Column 3, lines 29 and 61;
"releasibly" should be --releasably--.

UNITED STATES PATENT AND TRADEMARK OFFICE

CERTIFICATE OF CORRECTION

PATENT NO. : 5,765,932
DATED : June 16, 1998
INVENTOR(S) : Chris L. Domina, et al It is certified that error appears in the above-identified patent and that said Letters Patent is hereby corrected as shown below:

Column 4, line 37;
Before "non-oval" insert the word --is--.

Column 5, Claim 8, Line 15;
"claim 8" should be --claim 7--.

Signed and Sealed this

Seventeenth Day of November, 1998

Bruce Lehman

*Attest:*

BRUCE LEHMAN

*Commissioner of Patents and Trademarks*

*Attesting Officer*